United States Patent [19]

Haglund

[11] Patent Number: 4,930,195

[45] Date of Patent: Jun. 5, 1990

[54] PRESENT INVENTION RELATES TO A SAFETY-BELT BUCKLE

[75] Inventor: Artur L. Haglund, Vargarda, Sweden

[73] Assignee: General Engineering (Netherlands) B.V., Utrecht, Netherlands

[21] Appl. No.: 308,427

[22] Filed: Feb. 9, 1989

[30] Foreign Application Priority Data

Feb. 10, 1988 [GB] United Kingdom ..... 8803082

[51] Int. Cl.[5] ..... A44B 11/25

[52] U.S. Cl. ..... 24/636; 24/637

[58] Field of Search ..... 24/636, 637, 646

[56] References Cited

U.S. PATENT DOCUMENTS

| | | | |
|---|---|---|---|
| 3,481,009 | 12/1969 | Preston et al. | 24/637 |
| 4,451,958 | 6/1984 | Robben et al. | 24/636 |
| 4,454,634 | 6/1984 | Haglund et al. | 24/636 |
| 4,527,317 | 7/1985 | Straszewski et al. | 24/637 |
| 4,677,715 | 7/1987 | Escaravage | 24/637 |

FOREIGN PATENT DOCUMENTS

| | | | |
|---|---|---|---|
| 0196035 | 3/1908 | Fed. Rep. of Germany | 24/637 |

*Primary Examiner*—Victor N. Sakran

*Attorney, Agent, or Firm*—Spencer & Frank

[57] ABSTRACT

A buckle is intended to receive a tongue which is mounted on a safety-belt along a predetermined path. A latching member in the buckle engages the tongue. A push-button, associated with a separate actuating element, is provided to move the latching member between a latching position and a release position. The push-button is spring-biassed to a predetermined forward-most position. Part of the actuating element contacts the push-button when the tongue is inserted in the buckle, but is separated from the push-button when the tongue is not present in the buckle.

6 Claims, 3 Drawing Sheets

Figure 4A:
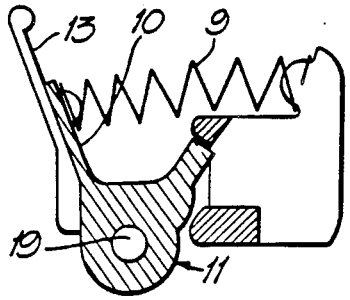
Figure 4B:
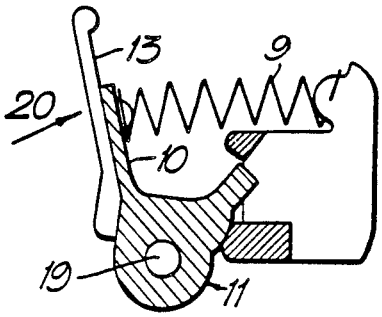

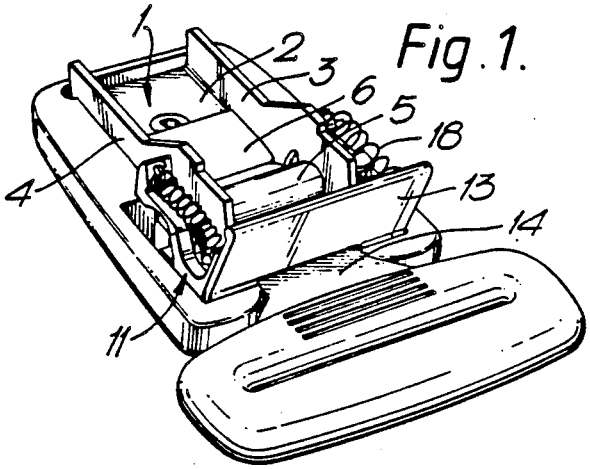
Fig. 1.
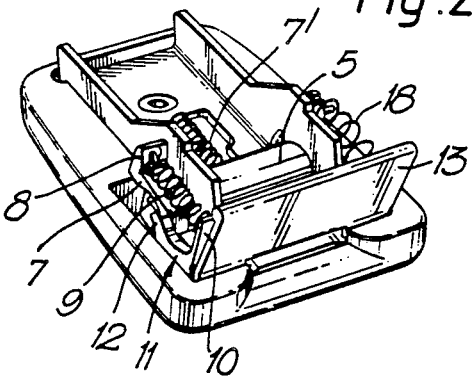
Fig. 2.
Fig. 5.
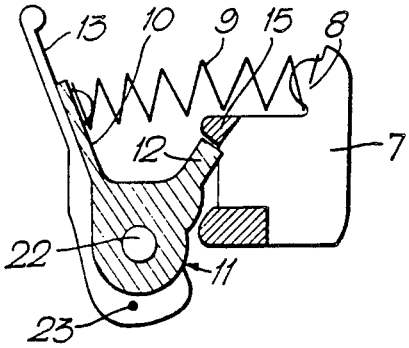

PRESENT INVENTION RELATES TO A SAFETY-BELT BUCKLE

It has been proposed to provide a safety-belt buckle adapted to receive a tongue present on a portion of a safety-belt and to retain that tongue. Such a prior-proposed safety-belt buckle incorporates a push-button or similar device which can be manually operated in order to release the tongue from the buckle.

In many of the prior-proposed buckles the tongue is ejected from the buckle by means of a spring-biassed ejector and, when the tongue has been ejected from the buckle, the ejector occupies the space that was occupied by the tongue. It is quite common for buckles of this type to incorporate a latching member which, when the tongue is inserted in the buckle, occupies a latching position in which part of the latching member engages an abutment formed in the tongue. The abutment may be formed by one wall of an aperture formed in the tongue, or by part of a "T" shaped head section of the tongue. When the tongue is to be ejected from the buckle, the push-button or the like is depressed, and a mechanical linkage causes the latching member to be moved away from the latching position to a release position. The spring-biassed ejector then ejects the tongue from the buckle, and when the tongue has been ejected from the buckle, the ejecting member is located where the tongue was located. The latching member is thus unable to return to the latching position and, in many prior art buckles, the press-button, which is mechanically linked to the latching member, also does not return to its initial position. This can be a disadvantage.

According to this invention there is provided a buckle adapted to receive a tongue mounted on a safety-belt, said buckle comprising means defining a path to receive the tongue, a latching member to engage the tongue, a push-button associated with a separate actuating element adapted to move the latching member between a latching position, in which the tongue is latched within the buckle, and a release position, the push-button being spring-biassed to a predetermined forward-most position, part of said actuating element contacting the push-button when the tongue is inserted in the buckle, but being separated therefrom when the tongue is not present in the buckle.

Preferably the buckle comprises a channel element having two upstanding side walls, the latching member extending between the side walls, the tongue being insertable into the buckle along a path extending between the base of the channel and the latching member, said actuating element comprising a pivotal element having a projection thereon engagable with axially extending projections formed on an element mounted on one end of the latching element to effect said movement of the latching element from the latching position to the release position.

Conveniently a spring-biassed ejector element is provided adapted to eject the tongue from the buckle when the latching member is in the release position.

Advantageously the ejector element, when it has ejected the tongue from the buckle, is located adjacent the latching member and serves to prevent the latching member returning to the latching position.

Preferably the push-button is a pivotally mounted push-button.

In one embodiment two springs are provided, one to bias the push-button and one to bias the actuating element.

Preferably the actuating element is pivotally mounted for movement about the same pivotal axis as the push-button.

Alternatively the actuating element is pivotally mounted on the push-button, a single spring being provided to biass the push-button and the actuating element to said forward-most position.

In order that the invention may be more readily understood, and so that further features thereof may be appreciated, the invention will now be described, by way of example, with reference to the accompanying drawings in which FIG. 1 is a perspective view of a buckle in accordance with the invention with the tongue inserted, FIG. 2 is a view corresponding to FIG. 1 but with the tongue ejected, FIG. 3A, 3B, 3C and 3D show the cycle of operation of parts of a buckle in accordance with the invention, FIGS. 4A, 4B, 4C and 4D correspond to FIGS. 3A, 3B, 3C and 3D which show the cycle of operation of additional parts of a buckle in accordance with the present invention and, FIG. 5 is a view corresponding to part of FIG. 4 illustrating a modified embodiment of the invention.

Referring initially to FIGS. 1 and 2 of the accompanying drawings a buckle, in accordance with the invention, comprises a channel-shaped element 1 having a base 2 and two upstanding side walls 3,4. A latching member 5 extends transversley across the channel shaped element 1, the ends of the latching member extending through apertures formed in the side walls 3,4 so that the latching member is rotatably mounted.

A spring biassed ejector element 6 is provided which slides along the base 2 of the channel 1 under the biass of a spring 7, as is conventional in buckles of this type.

On one end of the latching member 5, at a position located outside the channel, is an element 7 provided with a projection 8 which forms an abutment for one end of the spring 9, the other end of which engages a projection 10 formed on a pivotally mounted actuating element 11. The actuating element 11 is provided with a projection 12 which co-operates with projections formed on the element 7 in order to cause the latching member to rotate between latching and release positions, and to provide a locking function. A pivotally mounted push-button 13 is provided which is located in front of the actuating element 11, but which is pivotal about the same pivot axis.

A tongue 14 may be retained within the buckle, as shown in FIG. 1, or may be ejected from the buckle, in which case the buckle has the configuration illustrated in FIG. 2.

FIGS. 3A–3D illustrate diagramatically the cycle of operation of certain components of the buckle, illustrating the actuating element 11, and the end element 7 provided at the end of the latching element 5.

FIGS. 3A–3D illustrate the projection 8 formed on the end element 7, and the spring 9 which extends between the projection 8 and the corresponding projection 10 on the actuating member 11. The projection 12 formed on the actuating member is located to co-operate with two axially extending projections 15,16 which are formed on the end element 7.

Figure 3A:
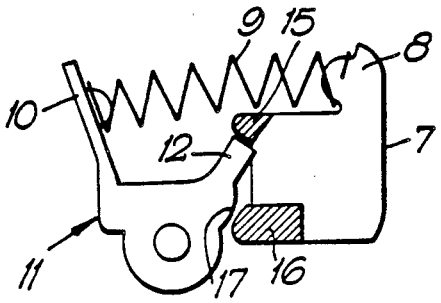
Figure 3B:
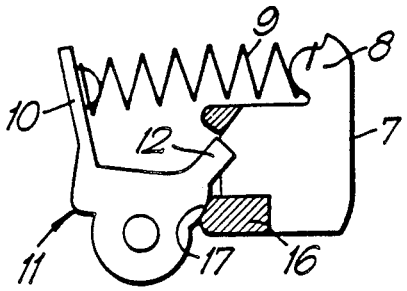
Figure 3C:
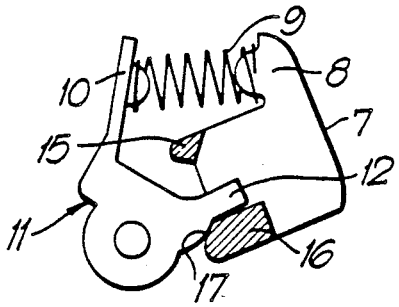
Figure 3D:
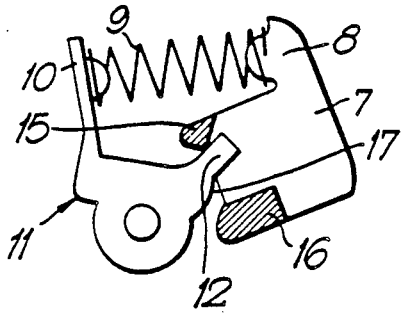

FIG. 3A shows the position of the illustrated components when the buckle is in the latching condition, as shown in FIG. 1. It is to be seen that the free end of the projection 12 is located immediately adjacent the axially extending projection 15 formed on the end element 7. Having regard to the orientation illustrated in FIG. 3A if the latching member is to move to the release position, the end element must rotate in an anticlockwise direction. However, if the end element 7 does begin to rotate in an anti-clockwise direction the projection 15 will engage the free end of the projection 12, thus preventing any further rotation of the end element 7. In other words, the arrangement of the components is such that the latching element is retained in the latching condition and cannot rotate to the release position.

When the buckle is to be actuated to release the tongue, as will be described hereinafter, the actuating element 11 is moved pivotally in a clock-wise direction as illustrated. The actuating element 11 thus moves to the position illustrated in FIG. 3B. It is to be noted that the end of the projection 12 is no longer aligned with the projection 15, and also a bulbus projection 17, formed towards the base of the projection 12, is engaging the axially extending projection 16. It will be understood that further movement of the actuating element in a clock-wise direction will cause the end element 7 to rotate in an anti-clockwise direction, so that the components then have the condition illustrated at FIG. 3C. This rotation of the end element 7 causes the latching member 5 to rotate to a release position. Detents formed on the latching member 5 which, in the locking position, engage corresponding detents formed on the tongue 14, become dis-engaged from the tongue, thus enabling the tongue to be ejected from the buckle by the spring-biassed ejector 6. The ejector 6 moves forwardly, and comes to rest under the latching element 5. If the force that has been applied to the actuating element 11 is then released, the actuating element will move in an anti-clockwise direction, but the latching element will remain in the same position. Thus the end element 7 remains in the same position, whilst the actuating element 11 moves in an anti-clockwise direction to the position illustrated in FIG. 3D. It is to be noted that the projection 12 becomes engaged on: the projection 15, thus preventing the actuating member 11 from returning to its initial condition.

Returning now to FIGS. 1 and 2, it is to be observed that the push-button element 13 is associated with its own spring 18, on the opposite side of the channel to the spring 9, which exerts a forward biass to the push-button, and which also exerts an anti-clockwise bias to an end element (not shown) on the other end of the latching element, thus biassing the latching element to the latching position. As can be seen in FIG. 1, the actuating element 11 is biassed to a forward position by the spring 9 when the tongue is inserted in the buckle, so that the projection 10 on the actuating element 11 flushly engages a rear face of the push-button 13 which is also biassed to a forward-most position by its own spring 18. However, when the buckle is in the condition illustrated in FIG. 2, the latching member is in an intermediate position, but the push-button 13 is still biassed to its forward-most position by the spring 18. Thus, regardless of whether the tongue is in the buckle or out of the buckle the push-button 13 is always biassed to its forward-most position.

Referring now to FIG. 4 of the accompanying drawings, it will be appreciated that FIGS. 4A to 4D correspond to FIGS. 3A-3D respectively, but show in addition to the actuating element 11, the push-button 13.

It is to be appreciated that push-button 13 is mounted for pivoting movement about an axis 19, which is the same as the axis about which the actuating element 11 rotates. As can be seen in FIG. 4A, when the buckle is in the condition illustrated in FIG. 1, with the tongue inserted in the buckle, the push-button 13 has the rear surface thereof flush with one face of the projection 10 formed on the actuating member 11. When the buckle is moved to the condition illustrated in FIG. 4B the push-button 13 is pushed forwardly in the direction of the arrow 20, by applied manual pressure and thus the rear face of the push-button 13 still remains in contact with the front face of the projection 10.

Figure 4C:
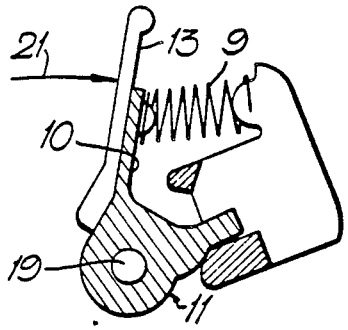
Figure 4D:
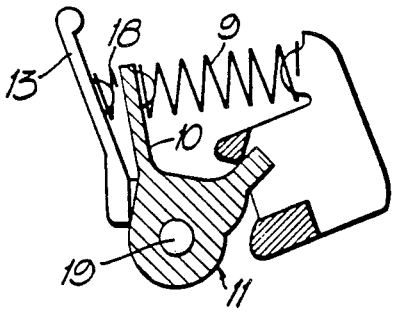

Similarly, as the buckle moves to the condition illustrated in FIG. 4C, manual pressure is still applied in the direction of the arrow 21, thus still maintaining the rear face of the push-button 13 in contact with the front face of the projection 10. However, when the buckle is returned to the condition illustrated in FIG. 4D, as has been explained above, the latching element cannot be moved from its position as illustrated in FIG. 4C, and thus the actuating element 11 can only move to an intermediate position. However, the spring 18 continues to biass the push-button 13 forwardly until it reaches its terminal position, as illustrated in FIG. 4D. It will thus be appreciated that, regardless of the condition of the buckle, the push-button 13 is always spring biassed to its forward-most position.

Whilst, in FIGS. 1 to 4D, an example of the invention has been described in which two springs are provided, one to biass the actuating element forwardly, and one to biass the push-button forwardly, FIG. 5 illustrates a modified embodiment of the invention, this view corresponding to view 4A. In this embodiment of the invention the actuating member 11 is actually pivotally mounted on the push-button 13 about a pivot axis 22, and the push-button 13 itself is pivotally mounted on the channel for pivoting movement about a pivot axis 23. A single spring 9 is provided extending between the projection 8 formed on the end element 7 of latching member, and the projection 10 of the actuating element 11. Since the pivot axis 22 is located above spring 9 to the actuating element 11 will tend to impart an anti-clockwise directional biass to the push-button 13. It is to be appreciated that the device will operate substantially as the device described above, but when the tongue is ejected from the buckle, and the push-button is then released, the spring 9 will biass the actuating element rotationally until the projection 12 engages with the projection 15, and the spring biass will then cause the push-button 13 to continue to rotate about the pivot axis 23. This will cause some sliding movement between the projection 12 and the projection 15, but the length of the projection 12 is such that it still remains engaged with the projection 15 even when the push-button 13 has moved to its forward-most position.

Whilst the invention has been described with reference to specific embodiments it is to be appreciated that many modifications may be effected without departing from the scope of the invention.

I claim:

1. A buckle adapted to receive a tongue mounted on a safety-belt, said buckle comprising means defining a path to receive the tounge, a latching member to engage the tongue, a spring baissed member adapted to eject the tongue from the buckle, a push-button associated with a separate actuating element adapted to move the latching member between a latching position in which the tongue is latched within the buckle and a release position, in which the toungue is ejected from the buckle by the ejector and the ejector becomes located adjacent the latching member, preventing the latching member from returning to the latching position, the push-button being spring-biassed to a predetermined forward-most position, part of the actuating element contacting the push-button when the tongue is inserted in the buckle, the actuating element being connected to the latching member in such a way that when the tongue has been ejected from the buckle the actuating element is retained in a position in which it is separated from the push-button, when the push-button has been spring-biassed to said predetermined forward-most position.

2. A buckle according to claim 1 comprising a channel element having two upstanding side walls, the latching member extending between the side walls, the tongue being insertable into the buckle along a path extending between the base of the channel and the latching member, said actuating element comprising a pivotal element having a projection thereon engagable with axially extending projections formed on an element mounted on one end of the latching element to effect said movement of the latching element from the latching position to the release position.

3. A buckle according to claim 1 wherein the push-button is a pivotally mounted push-button.

4. A buckle according to claim 3 wherein the actuating element is pivotally mounted for movement about the same pivotal axis as the push-button.

5. A buckle according to claim 3 wherein the actuating element is pivotally mounted on the push-button, a single spring being provided to biass the push-button and the actuating element to said forward-most position.

6. A buckle according to claim 1 wherein two springs are provided, one to bias the push-button and one to bias the actuating element.

* * * * *